United States Patent [19]

Reed et al.

[11] 3,940,234

[45] Feb. 24, 1976

[54] NOISELESS PMS BURNER

[75] Inventors: Robert D. Reed; John Smith Zink; Hershel E. Goodnight, all of Tulsa, Okla.

[73] Assignee: John Zink Company, Tulsa, Okla.

[22] Filed: May 28, 1974

[21] Appl. No.: 473,356

[52] U.S. Cl. ..... 431/348; 431/181; 431/174; 432/222; 431/114

[51] Int. Cl.[2] ..... F23D 13/12

[58] Field of Search ..... 431/348, 347, 114, 167, 431/166, 181, 353, 174; 432/175, 222

[56] References Cited

UNITED STATES PATENTS

| | | | |
|---|---|---|---|
| 2,158,522 | 5/1939 | Nahigyan | 431/174 |
| 3,514,245 | 5/1970 | Adcock | 431/348 |
| 3,671,172 | 6/1972 | Chedaille et al. | 431/174 |
| 3,684,424 | 8/1972 | Zink et al. | 431/114 |
| 3,711,243 | 1/1973 | Zink et al. | 431/181 |
| 3,834,864 | 9/1974 | Jakobi et al. | 432/222 |
| 3,838,652 | 10/1974 | Schol | 432/222 |

*Primary Examiner*—John J. Camby
*Assistant Examiner*—Henry C. Yuen
*Attorney, Agent, or Firm*—Head, Johnson and Chafin

[57] ABSTRACT

A noiseless premix burner comprising a cylindrical housing which is attached to the outer covering of the furnace wall, and closed at its opposite end by a closure plate which supports a concentric burner tube which extends from the closure plate through an opening in the furnace wall to the interior of the furnace. A gas fuel line is inserted along the axis of the burner tube. Pressurized fuel gas flows through an orifice in the fuel line in an expanding flow. The proximal end of the burner tube has a venturi type throat construction. The annular space between the burner tube and the cylindrical housing comprises two plenums, one adjacent the outer wall of the furnace supplying secondary air, which passes into the furnace through a narrow annular gap between the burner tube and the furnace lining. The second plenum provides primary air to the burner tube at the position of the fuel nozzle, where it mixes turbulently with the inflowing high velocity gas stream, to provide a fuel-air mixture which passes down the burner tube. The axial outlet of the burner tube inside the furnace is closed and there are a plurality of longitudinal slots spaced circumferentially around the burner tube through which the gas-air mixture moves radially into the furnace impinging on tile which surrounds the burner tube.

5 Claims, 4 Drawing Figures

NOISELESS PMS BURNER

BACKGROUND OF THE INVENTION

This invention lies in the field of fuel gas burners for furnaces. More particularly, it concerns a type of burner which is more or less completely sealed so as to minimize the noise of the issuing gas and mixing activity, so that on the outside of the burner housing the level of noise is nominal.

CROSS REFERENCES TO RELATED PATENT

This invention is related to U.S. Pat. No. 3,684,424 in the names of John Smith Zink, Hershel Goodnight and Robert D. Reed dated Aug. 15, 1972, entitled "Noiseless Radiant Wall Burner."

In the prior art as represented by the U.S. Pat. No. 3,684,424, the noiseless character of the burner is provided at considerable expense in apparatus and construction to achieve the quiet operation.

SUMMARY OF THE INVENTION

It is a primary object of this invention to provide a noiseless premix burner with a simple and relatively inexpensive construction. It is a further object of this invention to provide a type of burner and tile construction such that by the incandescence of the tile the ignition of the gas and primary air mixture is continuously obtained. The tile construction is simpler and less expensive than in the prior art construction.

These and other objects are realized and the limitations of the prior art are overcome in this invention by providing a burner housing which is cylindrical metal tube with flanges adapted to be fastened at one end to the outer steel covering of the furnace wall and at the second end to be closed off by a mounting plate, which supports a gas fuel line on the axis of the cylinder and which also supports a burner tube of diameter less than the housing diameter. Air openings are provided in the burner tube at the input end which connects the interior of the burner tube with an annular plenum between the burner tube and the housing. Inlet air openings are provided in the outer wall of the housing to supply primary air and separate openings are provided to provide secondary air. An annular plate is inserted between the burner tube and the housing wall in order to divide the annular space into the two plenums. Means are provided for controlling the effective size of the air openings for the primary and secondary air. The burner tube is closed on its outlet end and the gas air mixture leaves the tube through a series of longitudinal slots which are spaced circumferentially around the burner tube. The gas-air mixture from the burner tube exiting through the slots impinges on a tile ring surrounding the burner tube which, in operation when the tile is incandescent, provides a positive means of continuously igniting the gas air mixture.

BRIEF DESCRIPTION OF THE DRAWINGS

These and other objects and advantages of this invention and a better understanding of the principles and details of the invention will be evident from the following description taken in conjunction with the appended drawings.

Figures 1, 2, 3, 4:
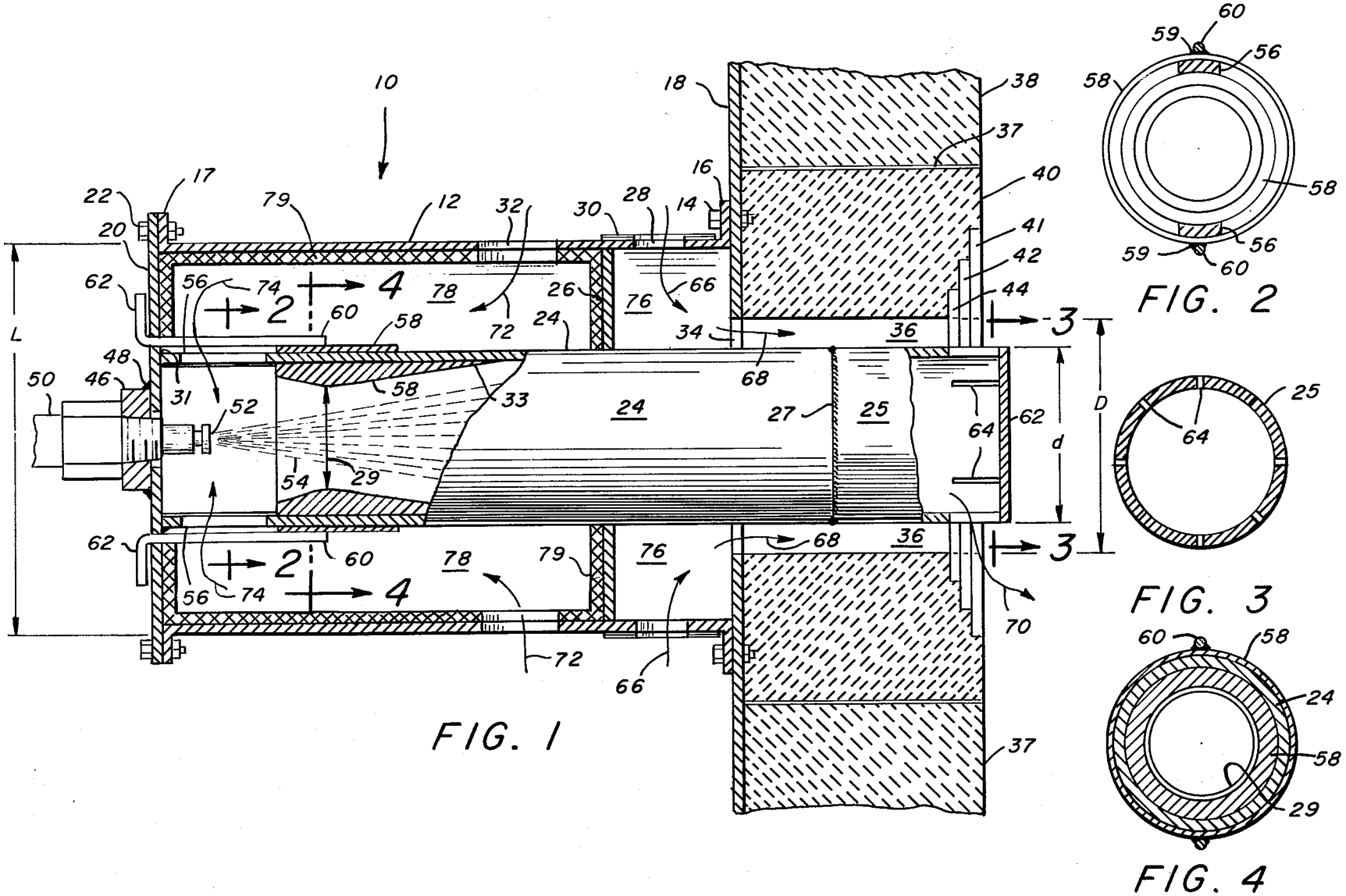
FIG. 1 represents a vertical cross section of the burner and furnace construction.
FIG. 2 is a transverse cross section of the burner along the plane 2—2.
FIG. 3 is a cross section of the burner tube in the plane 3—3.
FIG. 4 is a cross section of the burner tube at the plane 4—4.

Referring now to the drawings and in particular to FIG. 1 there is shown, indicated generally by the numeral 10, one embodiment of the burner of this invention. It comprises a cylindrical housing 12, preferably of a cylindrical circular nature having two flanged ends 16 and 17, the end 16 is mounted to the outer steel wall 18 of the furnace wall 38 by means such as bolts 14. The input end of the burner at the flange 17 is closed by a closure plate 20 and is fastened by means of bolts 22. The closure plate 20 supports an input fuel pipe 50 which can, for example, be supported by threads to a nut 46 welded by means 48 to the plate 20, so that the gas nozzle 52 is directed along the axis of the burner tube 24. The burner tube 24 is a cylindrical pipe of lesser diameter than the housing 12 and is supported by welding such as 31 to the closure plate 20.

As shown in FIG. 2, the major circumferential portion of the burner tube 24 is cut away leaving two longitudinal strips 56 to support the burner tube and providing large openings for the passage of primary air in accordance with the arrows 74. The input end of the burner tube 24 has a cylindrical insert 58 in the form of a tapered throat construction 58, providing a narrow throat of a diameter 29 and an expanding portion 33.

At its output end the burner tube 24 is closed off by means of a plate 62. There are a plurality of longitudinal slots 64 which are arrayed circumferentially around the tube. The gas and air mixture in the burner pipe 24 flows radially outwardly through these slots and impinges on the hot tile 40 which surrounds the end of the burner.

The tile 40 with the ceramic 38 forms part of the lining of the furnace. The outer surface 37 of the tile can be of any shape such as circular, square, etc. There is a central opening to the tile which is larger than the outer diameter of the burner tube 24 to provide an annular space 36 through which secondary air can reach the interior of the furnace.

The tile 40 shown with a plurality of circular recesses 41, 42, 44, etc. which serve as impingement edges so that when the furnace is in operation, these edges become incandescent and serve as continuing ignition means for the gas-air mixture flowing outwardly through the slots 64 against the tile edges.

There are two sets of circumferential openings in the burner housing, both sets mounted close to the furnace wall, but spaced apart to provide for an internal annular plate 26 that closes off the annular space between the burner tube and the housing, so as to form two air plenums 76 and 78.

The first series of openings 28 are covered by a circumferential tube 30 which has a corresponding plurality of holes of the same size and spacing, so that as the tube 30 is rotated with respect to the cylindrical housing 12, more or less area of the openings 28 can be covered by the tube 30, so as to control the effective size of the air openings and, therefore, control the amount of secondary air which flows inwardly in accordance with the arrows 66 through the annular space 36 in accordance with arrows 68 and into the furnace, to mix with the burning gases issuing from the slots 64 in the burner tube.

Inasmuch as the outer end of the burner tube is adjacent the hot flame provided by the ignited gases issuing from the slots 64, the outer portion 25 of the burner tube should be of high temperature resistant metal so as to be able to withstand the high temperature to which it will be subjected. On the other hand, since the input end of the burner tube is handling only cool gases, it does not have to be of high temperature metal. Therefore, the burner tube can be constructed of two parts an input end 24 of conventional steel pipe welded by means 27 to an output end 25 of high temperature steel.

The second set of openings 32 in the housing wall 12 are for primary air. These openings are toward the end of the housing attached to the furnace wall 18 so as to provide a sizable plenum 78 to help deaden the noise generated in the burner tube by the high velocity gases 54 issuing from the nozzle 52 and mixing with the primary air indicated by the arrows 72 and 74 passing along the annular space of the plenum 78.

It will be clear that the portion of the burner tube at the input end, where the noise generated by the issuing gases 54 and the turbulent mixing with the input air 74 in the throat 29 of the burner tube creates a considerable noise, this noise is entirely enclosed except for the openings 32, which are removed as far as possible from the source of noise. Thus, the amount of noise issuing through the openings 32 will be a minimum. However, if desired, it is possible to line the interior surface of the plenum 78 with acoustical insulating material 79 so as to further minimize the amount of noise that will be radiated from the housing 12.

The amount of primary air entering the burner tube in accordance with arrows 74 can be regulated by means of a short cylinder 58 surrounding the burner pipe 24. There are a pair of steel rods 60 attached to this short pipe 58 by means such as the welds 59 of FIG. 2. The rods 62 extend through appropriate openings in the closure plate 20 to the outside, where they form handles 62 so that they can be pulled out, or pushed in, as desired, appropriately moving the pipe 58 so as to cover more or less of the openings in the input end of the burner pipe.

The openings 28 and 32 in the wall of the housing 12 can be of any desired size sufficiently large to provide enough air in accordance with the flow of gaseous fuel. This information is well described in the literature of the industry and need not be discussed here. However, a plurality of openings 28 which may be for example comprised of eight openings of diameter, one inch to 1½ inches might usefully serve for the secondary air openings. As regards the opening 32 these might for example be 12 openings of 2 in. diameter. Adequate regulation is provided by the circumferential pipe 28 over the secondary air openings and the pipe 58 covering the openings in the input end of the burner pipe.

In normal operation because of the draft through the furnace and also because of the high velocity jet of gaseous fuel, the pressure inside the furnace will be less than atmospheric, and primary and secondary air will flow into the burner in accordance with the arrows 72, 74 and 66.

While the invention has been described with a certain degree of particularity, it is manifest that many changes may be made in the details of construction and the arrangement of components. It is understood that the invention is not to be limited to the specific embodiments set forth herein by way of exemplifying the invention, but the invention is to be limited only by the scope of the attached claim or claims, including the full range of equivalency to which each element or step thereof is entitled.

What is claimed is:

1. A quiet premix gaseous fuel burner assembly comprising:

a. a cylindrical housing means of diameter L having a first end supported against an outside wall of a furnace, said wall having a tile lined opening of diameter D, where D is less than L, along the axis of said housing, the second end of said housing closed by a mounting plate;

b. a gaseous fuel line with nozzle passing through said mounting plate along the axis of said housing, the pressureized gas flowing from said nozzle in an expanding cone of high velocity gas;

c. a burner pipe of diameter d, where d is less than D mounted at its second end to said mounting plate coaxially with said housing and extending at least to an inside wall of said furnace, primary air openings in said burner pipe at its second end and means to control the area of said openings, a closure over the first end of said burner tube, and a plurality of longitudinal slots distributed circumferentially around said pipe at said first end;

d. an annular plate in said housing closing off the annular space between said tube and said housing, forming a first plenum space between said plate and said furnace wall and a second plenum space between said annular plate and said mounting plate;

e. a plurality of secondary air openings into said first plenum and means to vary the area of said secondary air openings, said openings adapted to pass secondary air into said first plenum and into the annular space between said burner pipe and said tile; and f. a plurality of air openings on the wall of said housing adjacent said annular plate to convey air into said second plenum thence into said primary air openings.

2. The burner assembly as in claim 1 including an annular insert into the second end of said burner tube forming a throat of reduced diameter leading to an expanding conical surface.

3. The burner assembly as in claim 1 including acoustical insulation over at least part of the internal surface of the annular space comprising said second plenum.

4. The burner assembly as in claim 1 in which at least the first end of said burner tube is composed of high temperature resistant metal.

5. The burner assembly as in claim 1 in which said inside wall of said furnace which surrounds the first end of said burner tube is cut in a series of shallow cuts of decreasing diameter, providing sharp edges for the purpose of igniting the gas mixture.

* * * * *